US011285496B2

(12) United States Patent
Eriksson et al.

(10) Patent No.: US 11,285,496 B2
(45) Date of Patent: Mar. 29, 2022

(54) HYDROCYCLONE REJECT CHAMBER

(71) Applicants: Bengt Eriksson, Nashua, NH (US); Roger Becker, Nashua, NH (US)

(72) Inventors: Bengt Eriksson, Nashua, NH (US); Roger Becker, Nashua, NH (US)

(73) Assignee: VALMET TECHNOLOGIES OY, Espoo (FI)

( * ) Notice: Subject to any disclaimer, the term of this patent is extended or adjusted under 35 U.S.C. 154(b) by 0 days.

(21) Appl. No.: 16/738,395

(22) Filed: Jan. 9, 2020

(65) Prior Publication Data

US 2020/0222916 A1 Jul. 16, 2020

Related U.S. Application Data

(60) Provisional application No. 62/790,544, filed on Jan. 10, 2019.

(51) Int. Cl.

| | |
|---|---|
| ***B04C 5/181*** | (2006.01) |
| ***D21D 5/24*** | (2006.01) |
| ***B04C 5/04*** | (2006.01) |

(52) U.S. Cl.

CPC ..... *B04C 5/181* (2013.01); *B04C 5/04* (2013.01); *D21D 5/24* (2013.01)

(58) Field of Classification Search

CPC .. B04C 5/181; B04C 5/04; B04C 5/14; B04C 5/081; B04C 5/18; B04C 3/00; B04C 3/06; B04C 5/26; B04C 5/103; D21D 5/24; D21D 5/181; B01D 21/267

USPC ..... 210/512.1; 209/726, 729, 731, 733

See application file for complete search history.

(56) References Cited

U.S. PATENT DOCUMENTS 379,009 A * 3/1888 De Rycke ..... A47L 9/1683 55/426
3,417,871 A * 12/1968 Arnold ..... B04C 5/22 210/512.1
3,959,150 A * 5/1976 Frykhult ..... B04C 5/24 210/512.2

(Continued)

FOREIGN PATENT DOCUMENTS

CA 1138378 A * 3/1980 ..... B04C 5/14
GB 1015865 A * 1/1966 ..... B04C 5/081
WO WO9000646 A1 * 7/1988 ..... B04C 5/14

OTHER PUBLICATIONS

Merriam-Webster online dictionary, https://www.merriam-webster.com/dictionary/bump (Year: 2021).*

*Primary Examiner* — Claire A Norris
*Assistant Examiner* — Ekandra S. Miller-Cruz
(74) *Attorney, Agent, or Firm* — James Earl Lowe, Jr.

(57) ABSTRACT

A reject chamber for use with a hydrocyclone for separating a fiber suspension into a heavy fraction substantially containing heavy contaminants and a light fiber fraction substantially containing fibers, the reject chamber having an internal cavity, a reject inlet into the internal cavity, and a reject outlet out of the internal cavity, the longitudinal axis of the reject outlet being angled relative to the longitudinal axis of the reject inlet. The reject chamber has a stem that extends into the internal cavity at the elbow of the reject chamber, and at least two bumps, each of which extend into the chamber on opposite sides of the stem, the reject chamber taken along a cross section through the stem and between the bumps having symmetrical sides.

5 Claims, 11 Drawing Sheets

(56) References Cited

U.S. PATENT DOCUMENTS

| | | | | |
|---|---|---|---|---|
| 4,919,796 | A * | 4/1990 | Vikio | D21D 5/24 241/24.19 |
| 5,566,835 | A | 10/1996 | Grimes | |
| 5,934,484 | A | 8/1999 | Grimes | |
| 6,109,451 | A | 8/2000 | Grimes | |
| 6,284,096 | B1 | 9/2001 | Hartmann | |
| 6,758,343 | B1 | 7/2004 | Soto | |
| 2006/0163153 | A1 | 7/2006 | Caldelman | |
| 2014/0124437 | A1 | 5/2014 | Bachman et al. | |
| 2016/0129457 | A1 | 5/2016 | Valentina et al. | |

* cited by examiner

HYDROCYCLONE REJECT CHAMBER

CROSS-REFERENCE TO RELATED APPLICATION

This application claims the benefit of U.S. Provisional Application No. 62/790,544, filed 10 Jan. 2019.

BACKGROUND

The present disclosure relates to a hydrocyclone for separating a fiber suspension into a reject fraction substantially containing heavy contaminants and an accept fraction substantially containing fibers, comprising a housing with a circumferential wall defining an elongated separation chamber with two opposite ends and with a center axis extending between the opposite ends. The hydrocyclone further comprises an inlet member for supplying the fiber suspension substantially tangentially into the separation chamber at one end thereof, so that the fiber suspension flows in a vortex in the separation chamber, a first outlet member for discharging the accepts fraction from the separation chamber at said one end, and a second outlet member for discharging the rejects fraction from the separation chamber at the other end thereof.

An example of a conventional system can be found in US Published Application 2006/0163153 (the '153 system) published 27 Jul. 2006. A portion of that description is reproduced below, and like numbers for similar items are used in all of the drawings.

The '153 system is described in more detail in the following drawings, in which FIG. 1 shows a view of an axial cross-section through a hydrocyclone.

In FIG. 1 there is shown an example of a hydrocyclone 2 according to the '153 system, specially dimensioned for separating a fiber suspension containing relatively light and heavy contaminants. The hydrocyclone 2 comprises a housing 4, which forms a separation chamber 6, which is 49 cm in length, with a circumferential wall 8. The separation chamber 6 has a conical chamber section 10, and a cylindrical chamber section 12 connecting the base of the conical chamber section 10, whereby the separation chamber 6 has a relatively broad base end 14 and an opposite relatively narrow open apex end 16.

There is an inlet member 18 for supplying the fiber suspension tangentially into the cylindrical chamber section 12 at the base end 14 of the separation chamber. A first outlet member in the form of a pipe 20 extends centrally a distance into the cylindrical chamber section 12 from the base end 14 of the separation chamber 6 for discharging a light fraction of fiber suspension substantially containing fibers. A second outlet member 22 is arranged at the apex end 16 of the separation chamber 6 for discharging a heavy fraction of the fiber suspension containing heavy contamination particles, such as sand, metal fragments and the like. A third outlet member in the form of a pipe 24 having a substantially smaller diameter than the pipe 20 extends centrally through the pipe 20 for discharging a further light fraction of the fiber suspension containing light contamination particles, such as plastic fragments and the like. The hydrocyclone 1 further comprises a fluid supply device 26 for supplying liquid and/or gas to the conical chamber section 10 of the separation chamber 6 relatively close to the apex end 16.

During operation of the hydrocyclone 1 according to FIG. 1, the fiber suspension, which contains relatively light and heavy contaminants, is pumped by a pump 50 tangentially into the separation chamber 6 via the inlet member 18, so that a vortex of the fiber suspension is created in the separation chamber 6. As a result, the fiber suspension separates into an accepts fraction substantially containing fibers, which are discharged through the pipe 20, and a reject fraction containing relatively heavy contaminants, which are discharged through the outlet member 22.

A well-known problem that might arise during operation of hydrocyclones of this kind is that the heavy fraction, which typically has a substantially smaller flow than the light fiber fraction, thickens heavily and as a result might tend to clog the outlet member 22.

It is important to separate with as high a selectivity as possible within each hydrocyclone, i.e., minimize the fiber portion separated and discharged through the heavy fraction outlet of each hydrocyclone, without reducing the share of undesired particles. It is also important to reduce the fiber concentration in the heavy fraction outlet in order to avoid clogging of the heavy fraction outlet at the apex and obtain secure operation conditions. A smooth inside surface of the hydrocyclone may be used to obtain good dirt removal, as this allows the particles to migrate to the hydrocyclone wall with as moderate a disturbing turbulence as possible. However, this will at the same time increase the amount of rejected fibers that settles towards the hydrocyclone wall.

Consequently, an aim is to minimize the thickening factor, but there is a need of balancing so that the creating of a turbulent flow expanding fiber flocks will not disturb the helical vortex separating the undesired particles so that the separation efficiency of the hydrocyclone will not be diminished by for instance a larger share of remixing of either unseparated or remixing of already separated heavy particles into the hydrocyclone accept stream of light accept fibers.

SUMMARY

Disclosed is a reject chamber for use with a hydrocyclone for separating a fiber suspension into a heavy fraction substantially containing heavy contaminants and a light fiber fraction substantially containing fibers, the reject chamber having an internal cavity, a reject inlet into the internal cavity, and a reject outlet out of the internal cavity, the longitudinal axis of the reject outlet being angled relative to the longitudinal axis of the reject inlet. The reject chamber has a stem that extends into the internal cavity at the elbow of the reject chamber, and at least two bumps, each of which extend into the chamber on opposite sides of the stem, the reject chamber taken along a cross section through the stem and between the bumps having symmetrical sides.

The disclosed reject chamber has two bumps and thickens better no matter in what direction the circulation occurs and can be used with circulation in either direction.

Figure 1:
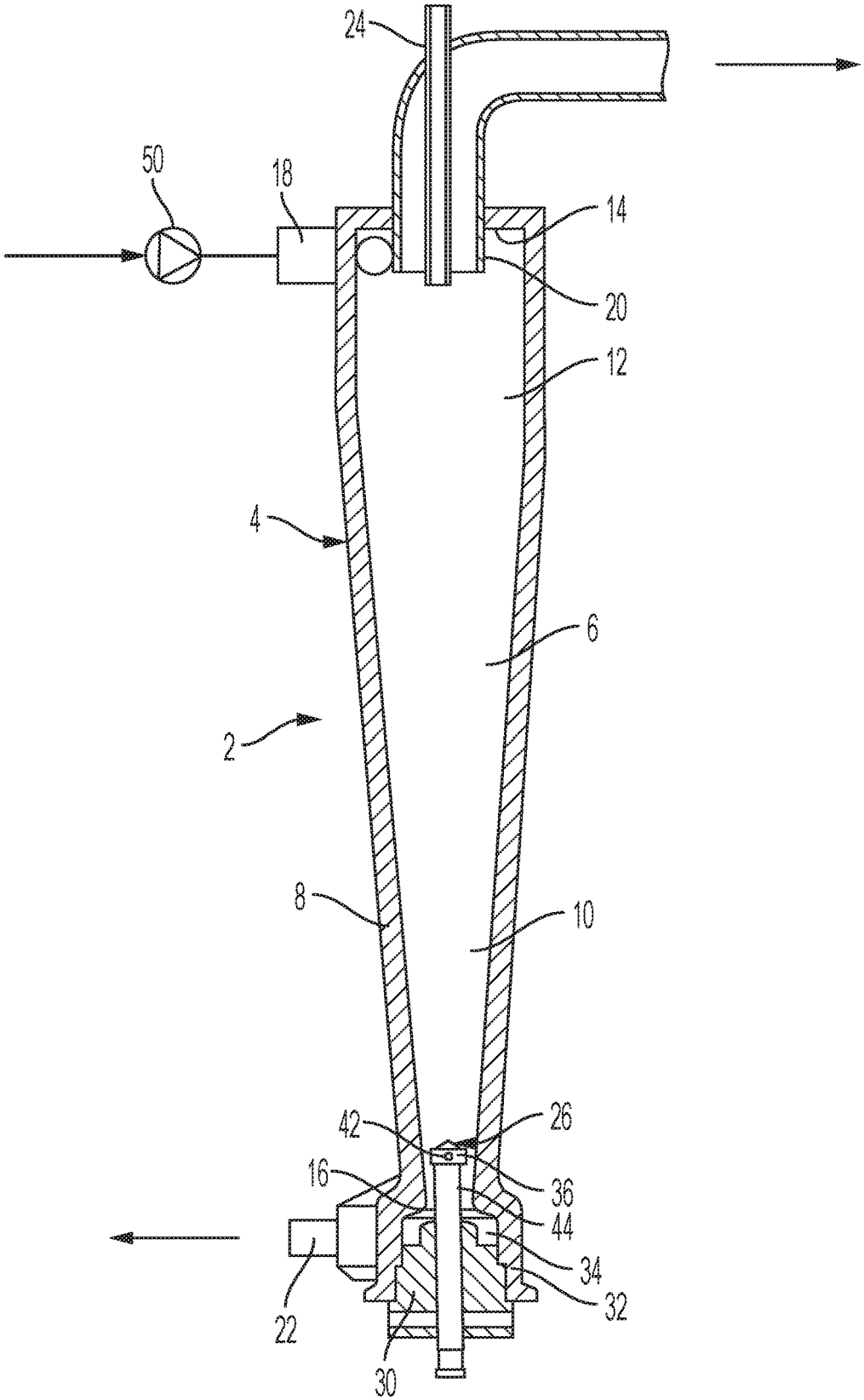
FIG. 1 PRIOR ART
FIG. 1 is a side view of an axial cross-section through a prior art hydrocyclone.
Figure 2:
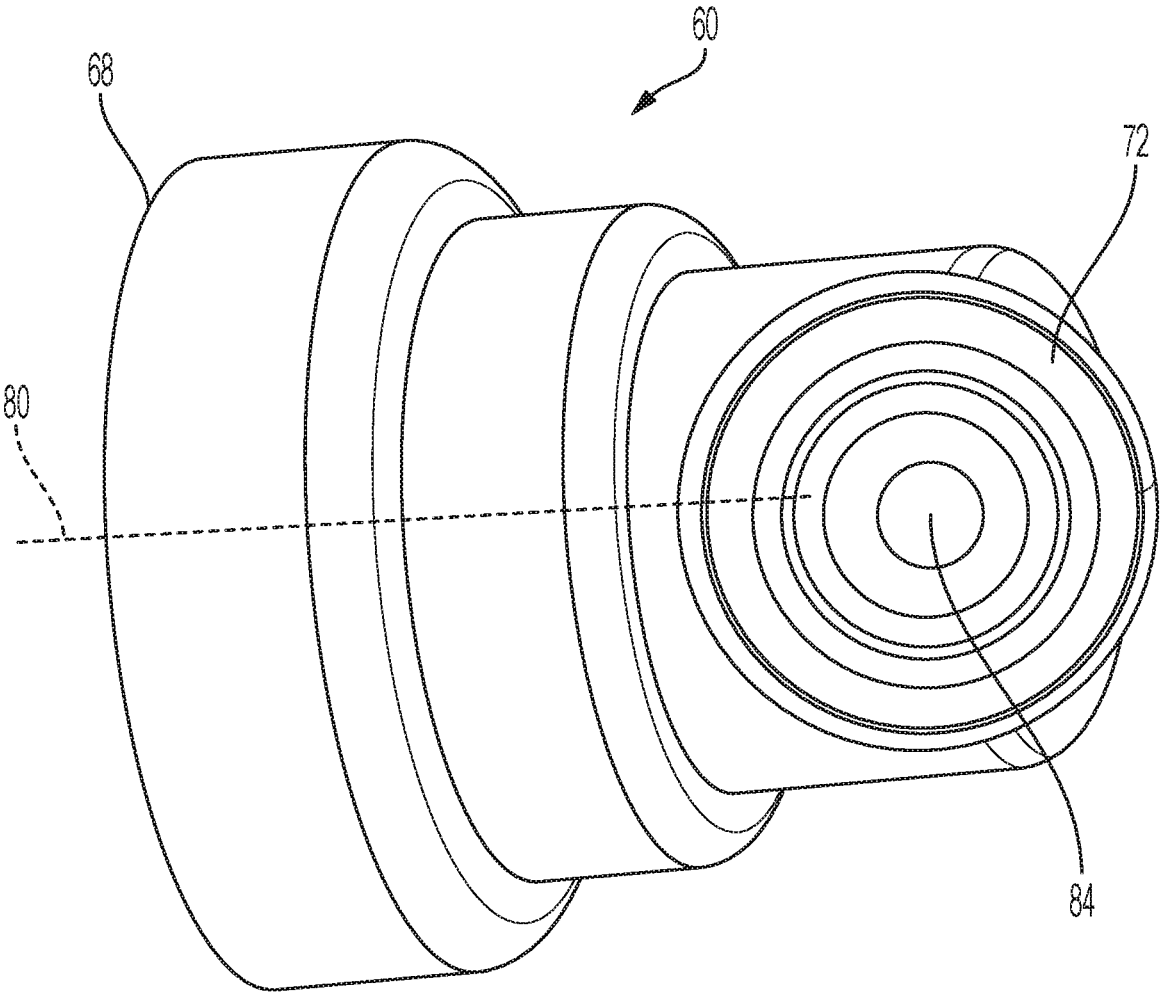
FIG. 2 is a top perspective view of a reject chamber according to this disclosure, which illustrates the symmetrical aspects of the reject chamber.
Figure 3:
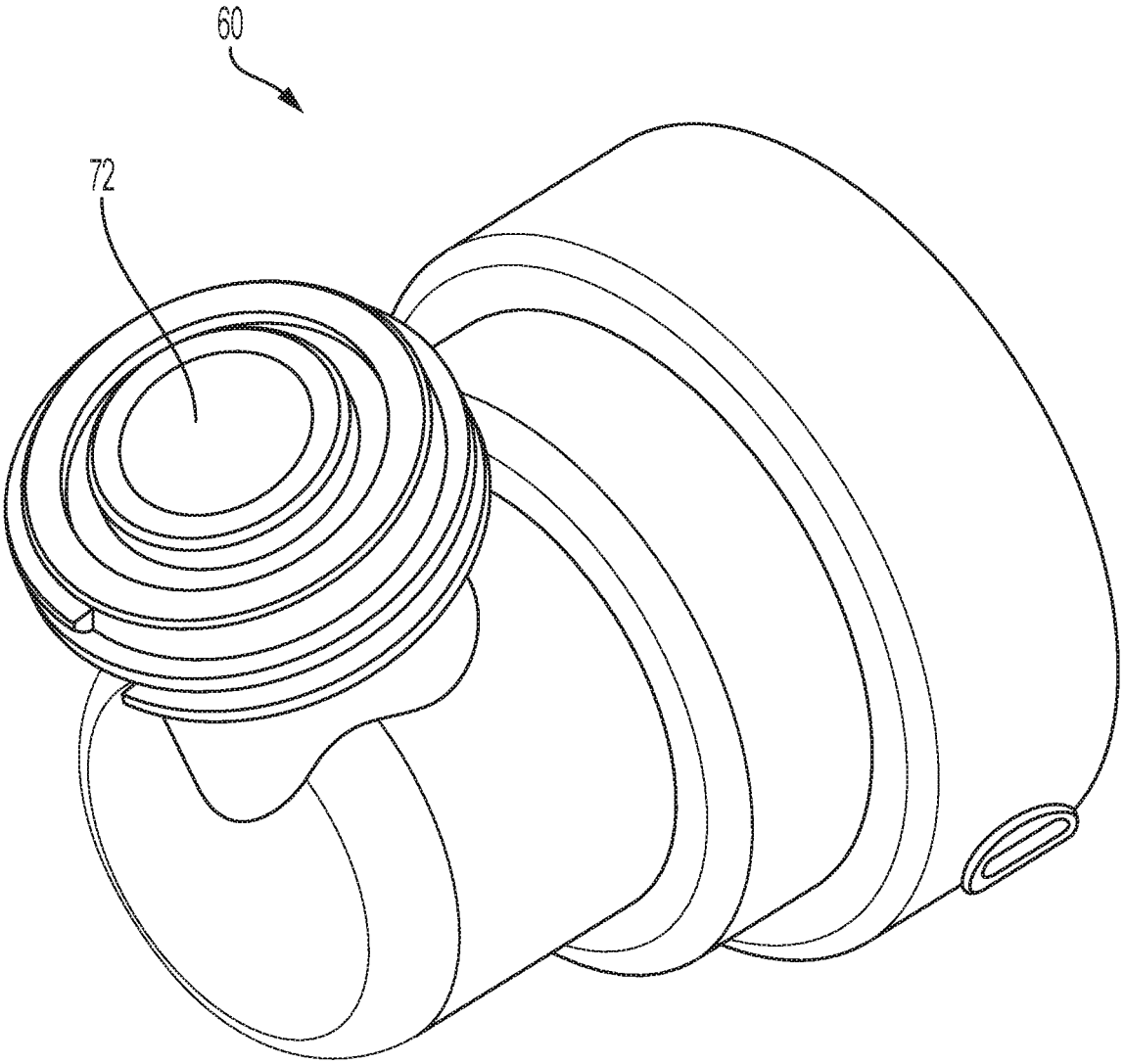
FIG. 3 is a side perspective view of the rejection chamber shown in FIG. 2.

All of the drawings accurately depict the reject chamber proportions.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward", "downward", "side", "top" and "bottom", etc., are words of convenience and are not to be construed as limiting terms.

DESCRIPTION OF THE EMBODIMENT

Figure 4:
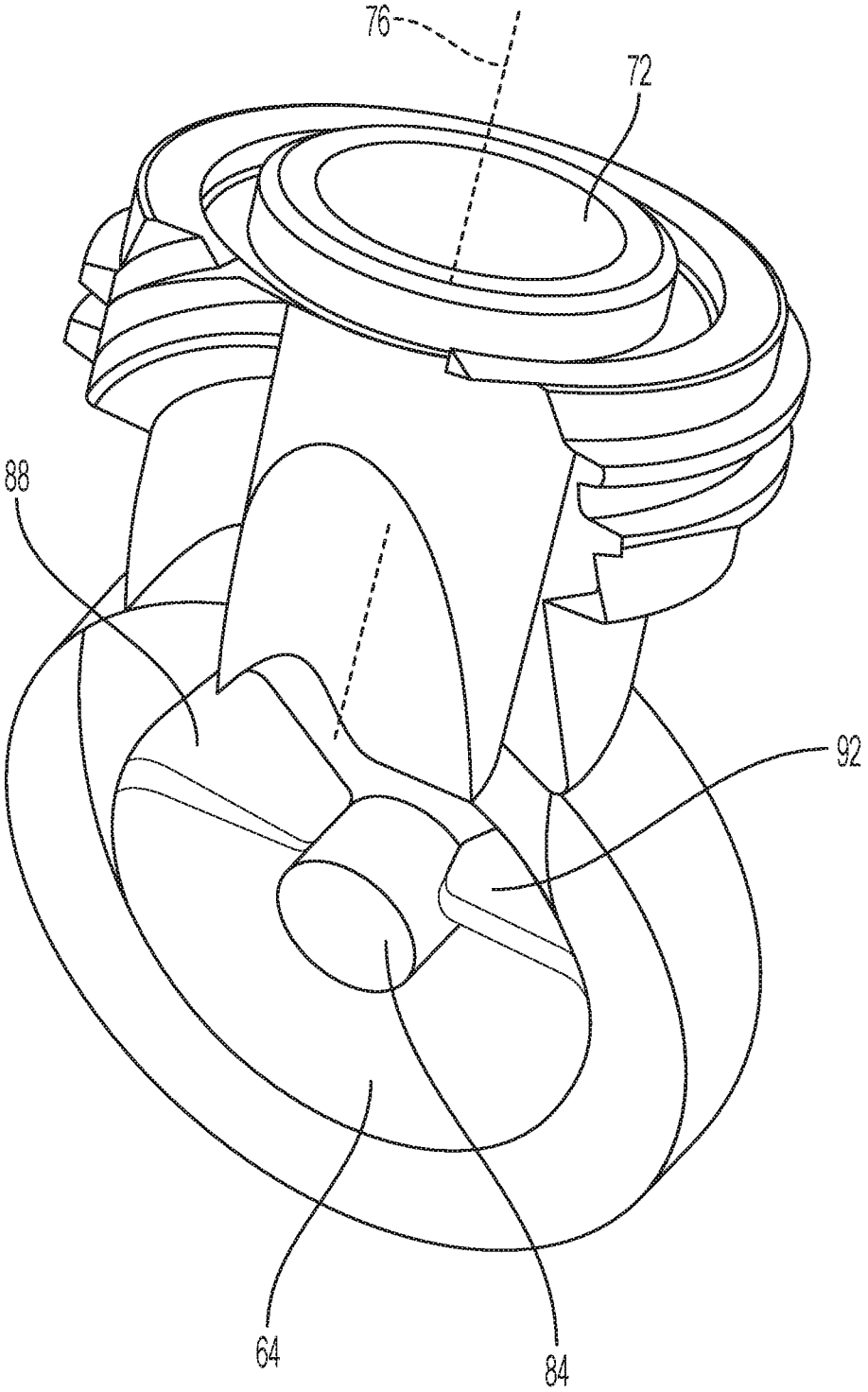
FIG. 4 is a partially broken way perspective view of the reject chamber of FIG. 2, illustrating two bumps and a portion of a stem present inside the reject chamber.
Figure 5:
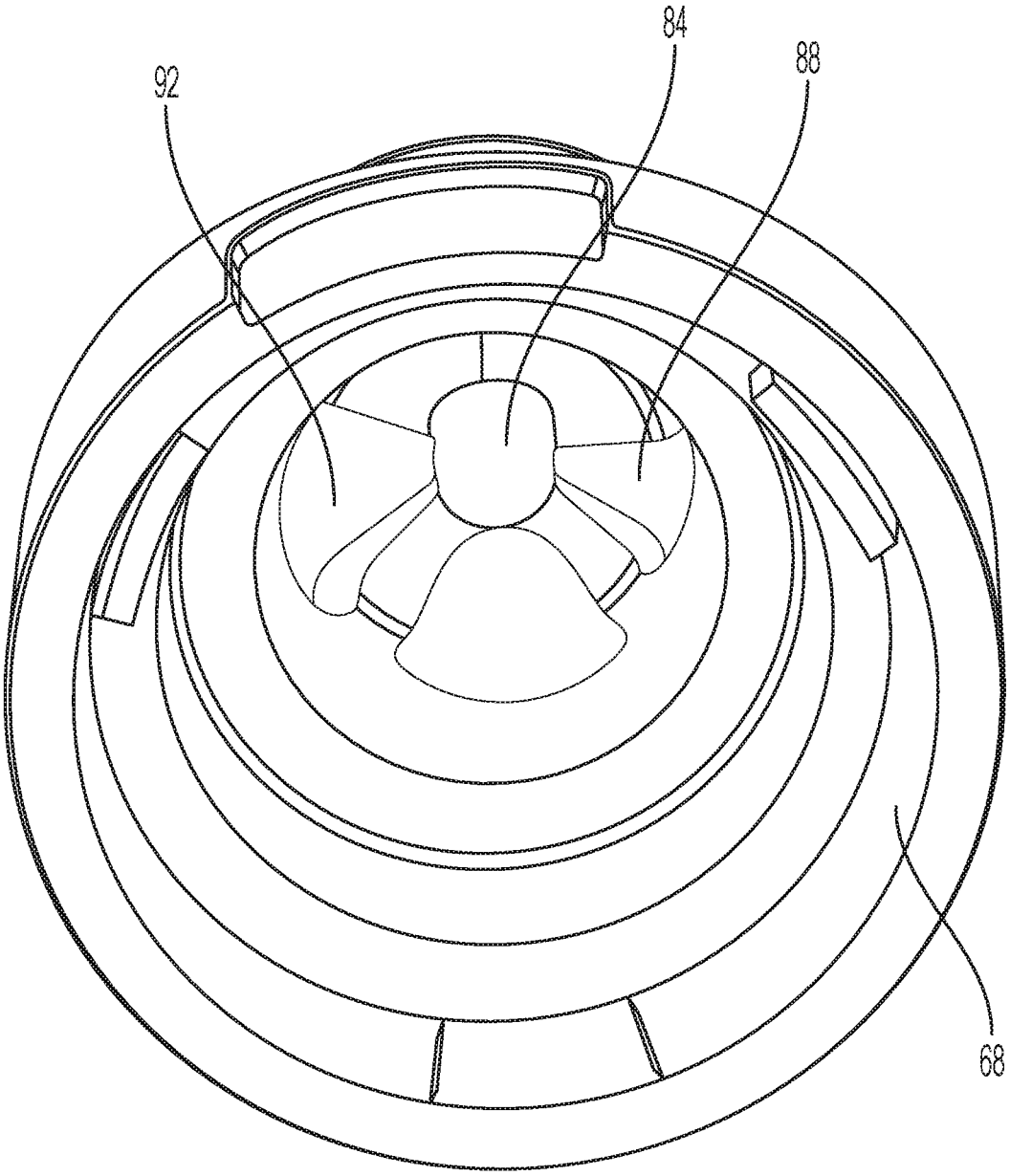
FIG. 5 is a top perspective view of the reject chamber of FIG. 2.

Disclosed is a reject chamber 60 having an internal cavity 64 (see FIG. 4), a reject inlet 68 (see FIG. 5) into the cavity 64, and a reject outlet 72 out of the cavity 64. In the disclosed embodiment, the longitudinal axis 76 of the reject outlet 72 is at a ninety-degree angle to the longitudinal axis 80 of the reject inlet 68, although the angle may be different in other embodiments. The reject chamber 60 is used in lieu of the second outlet member 22 and fluid supply device 26 in FIG. 1.

Figure 6:
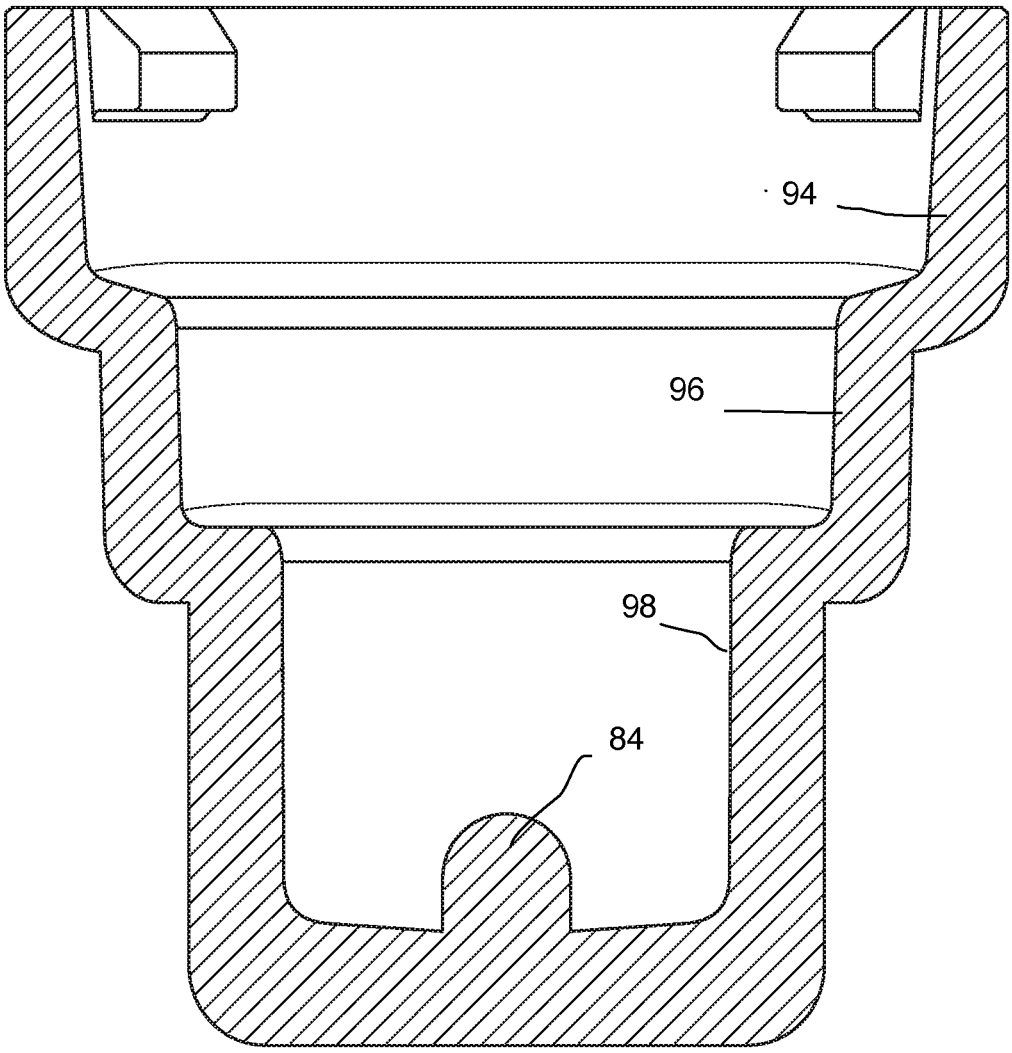
FIG. 6 is a side cross sectional view of the reject chamber through the center of the stem.
Figure 7:
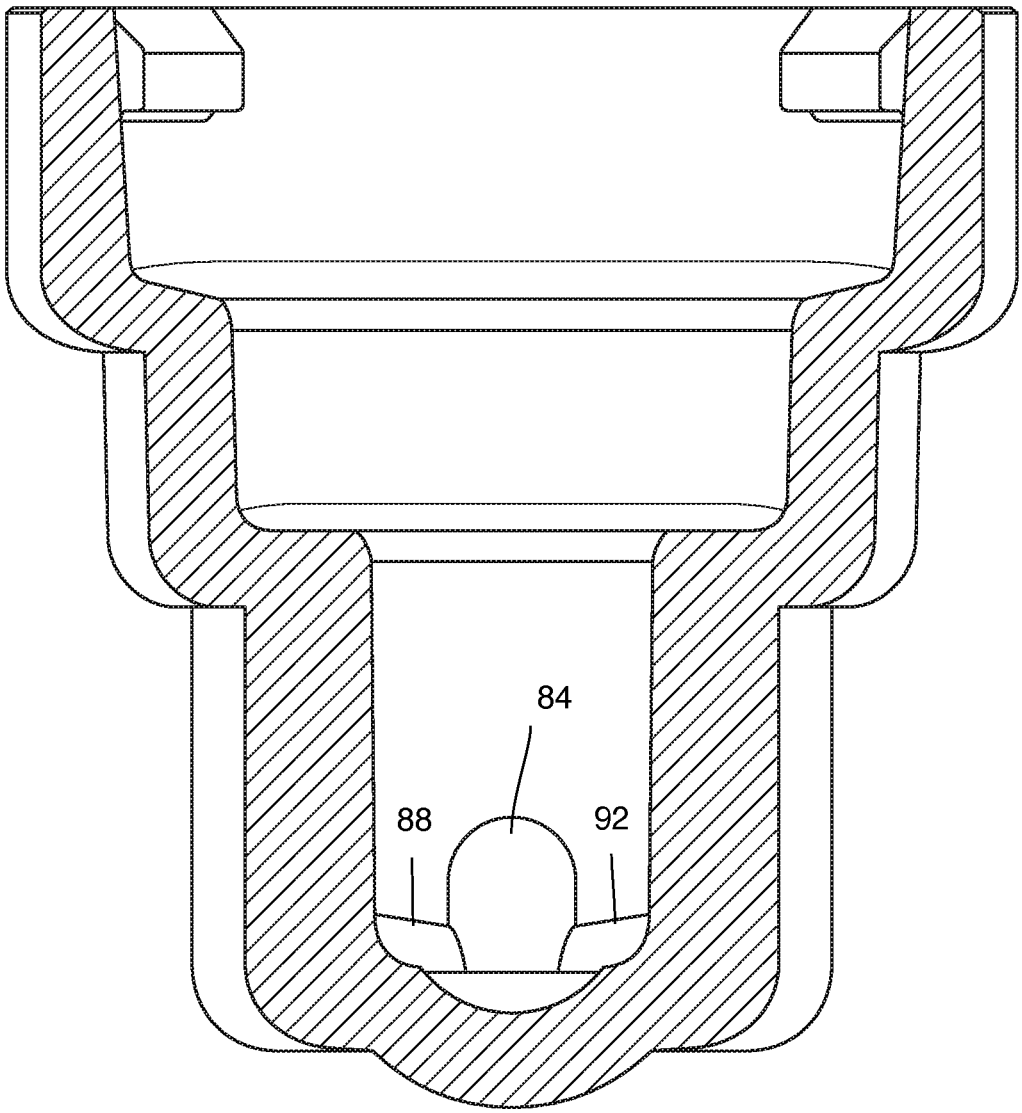
FIG. 7 is a partially broken away side view of the reject chamber illustrating the complete stem.
Figure 8:
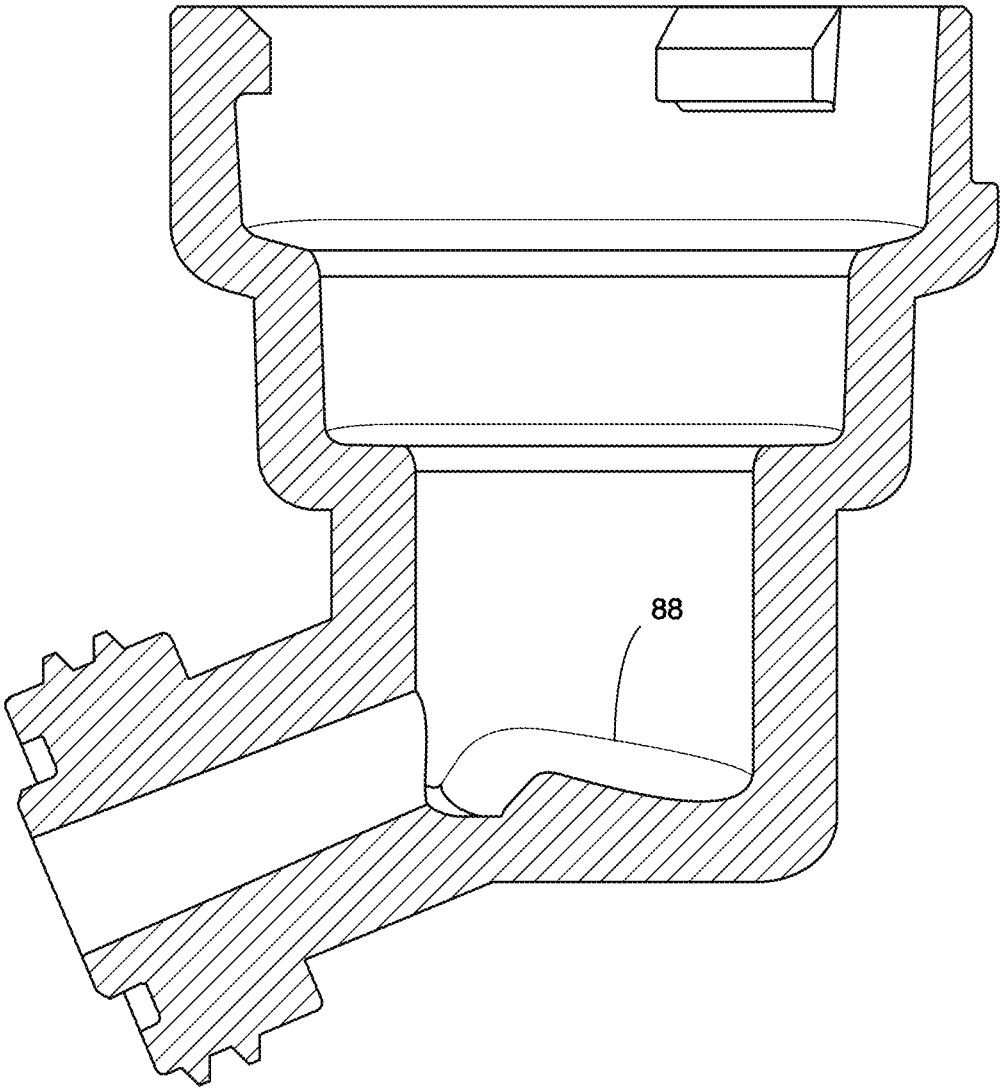
FIG. 8 is a cross sectional view though the reject chamber illustrating one of the bumps inside the reject chamber.
Figure 9:
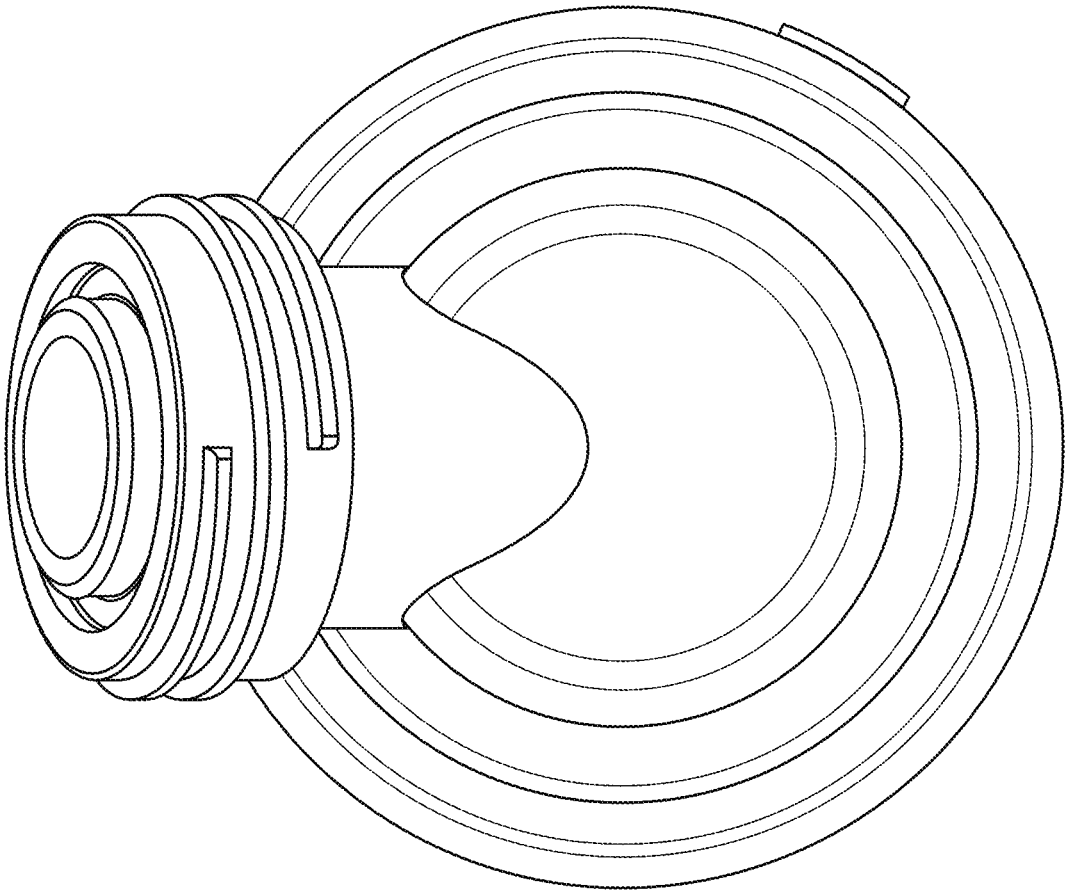
FIG. 9 is a bottom view of the reject chamber.
Figure 10:
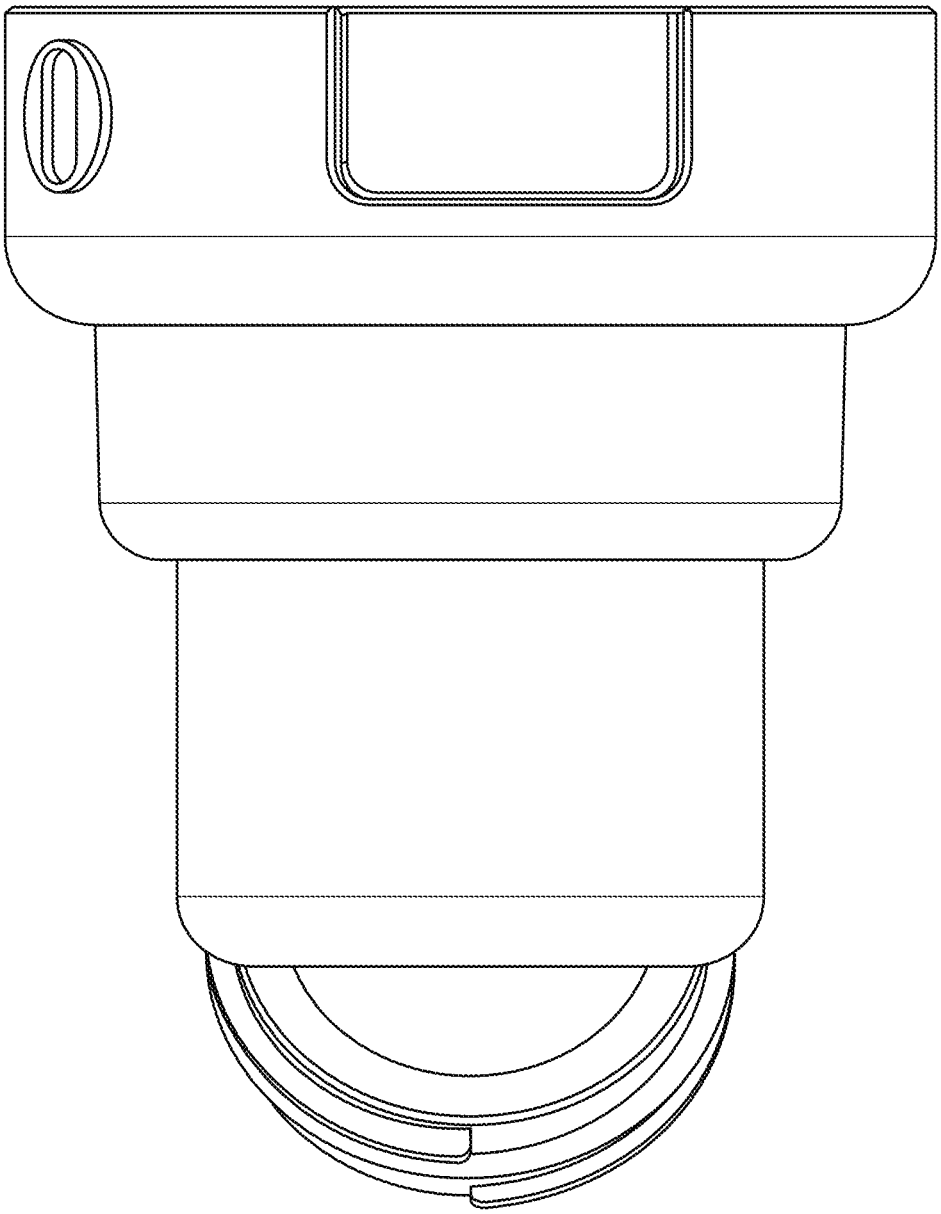
FIG. 10 is rear view of the reject chamber.
Figure 11:
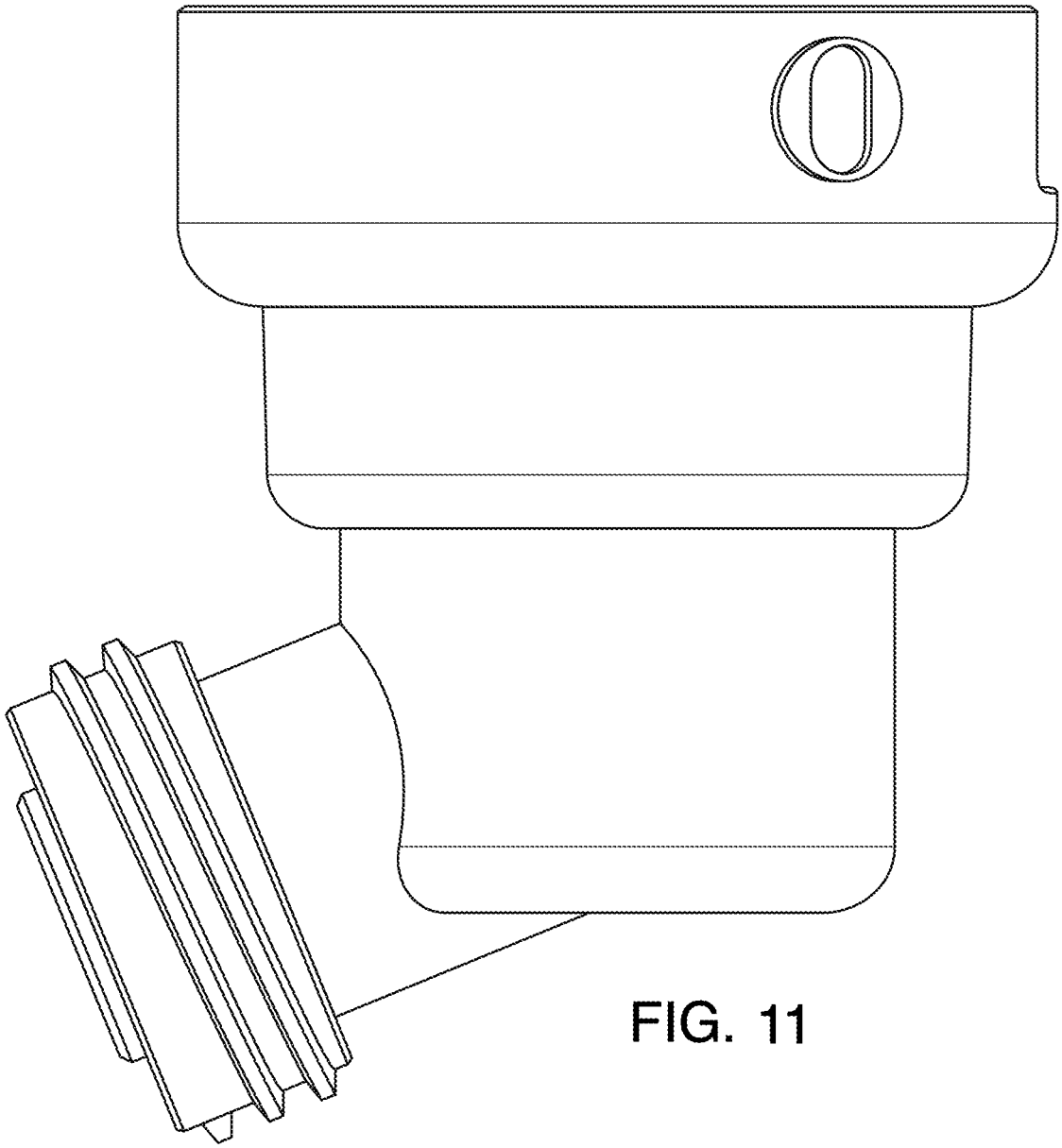
FIG. 11 is a side view of the reject chamber.

The disclosed reject chamber has two primary features. One is a centrally located stem 84, and the other is two ramps or "bumps" 88 and 92 on either side of the stem 84, as best seen in FIGS. 2 to 5. More particularly, located at the elbow of the reject chamber 60, where the reject inlet meets the reject outlet, is the stem 84 that extends into the internal cavity 64 along the longitudinal axis 80 of the reject inlet 68. Further, on either side of the stem 84, there are the pair of raised areas or bumps 88 and 92, each of which extend into the internal cavity 64. The reject chamber 60 taken along a cross section through the stem 84 and between the bumps 88 and 92 produces symmetrical sides. In the illustrated embodiment, the stem 84 is about 12 mm in length and has a domed top about 10 mm in diameter. The overall length of the reject chamber 60 is about 100 mm, and the bumps 88 and 92 are about 5 mm high. The diameter of the reject inlet 68 is about 68 mm, with the opening into the elbow portion being about 35 mm. As best seen in FIG. 6, the reject chamber has a connection collar 94 at the inlet 68, a reduced diameter mid-portion 96 and then a further reduced diameter elbow portion 98 which contains the stem 84 and bumps 88 and 92.

In other embodiments, the stem 84 is between 5 mm to 20 mm in length but extends no more than 7 mm above the associated bumps. The overall length of the reject chamber 60 is between 60 mm and 100 mm. The diameter of the reject inlet 68 is between 30 mm and 100 mm, and the bumps are between 1 mm and 10 mm high. The opening into the elbow portion is between 30 mm and 80 mm in diameter.

To date hydrocyclone reject chambers with shaped internals have been one sided. That is, the reject chambers can only be installed in a hydrocyclone that rotates in one direction. One conventional hydrocyclone is constructed in such a way that fluid in the hydrocyclone can rotate in either direction, however, as a result, two versions of such one-sided reject chambers are needed, with one for flow in one direction and the other for flow in the other direction. With the disclosed reject chamber, there is no need for two versions. There are also conventional reject chambers that are omnidirectional, but they do not have any internal shapes to aid in the separation of heavy rejects from lighter accepts.

The main advantage of this two-sided reject chamber 60 over existing one-sided versions is that it can be installed in a hydrocyclone that can fluid rotate in either clockwise or counterclockwise directions. In the pulp and paper industry, there is one such cleaner that due to the structure holding the cleaners is manufactured in such a way that the fluid in one side rotates clockwise, and the outer side counterclockwise. The main benefit of the two-sided reject chamber 60 is thus the need for only one reject chamber design in such a cleaner. The bumps 88 and 92 and stem 84 reduce the thickening factor, that is, reduce the amount of good fiber being rejected from the cleaner, and this is a major feature in any hydrocyclone. In addition, the disclosed reject chamber 60 has slightly better removal of impurities as compared to a one-sided reject chamber.

A single bump would probably have a very disturbing effect on a cleaner rotating in an opposite direction.

Various other features of this disclosure are set forth in the following claims.

The invention claimed is:

1. A hydrocyclone for separating a fiber suspension into a heavy fraction substantially containing heavy contaminants and a light fiber fraction substantially containing fibers, the hydrocyclone comprising a housing with a circumferential wall that defines an elongated separation chamber with two opposite ends and with a center axis extending between the opposite ends, an inlet member for supplying the fiber suspension substantially tangentially into the separation chamber at one end thereof, so that the fiber suspension flows in a vortex in the separation chamber, a first outlet member for discharging an accept fraction from the separation chamber at said one end, a reject chamber for discharging the heavy fraction from the separation chamber at the other end thereof, the reject chamber having an internal cavity, a reject inlet portion having a reject inlet into the internal cavity, and a reject outlet portion having a wall and a reject outlet out of the internal cavity, a longitudinal axis of the reject outlet portion being angled relative to a longitudinal axis of the reject inlet portion, a stem that extends into the internal cavity from the reject outlet portion along the longitudinal axis of the reject inlet portion where the reject inlet meets the reject outlet, and at least two bumps in the reject outlet portion wall, each of which extend into the internal cavity from the reject outlet portion and on opposite sides of the stem, the reject chamber taken along a cross section through the stem and between the bumps having symmetrical sides.

2. A reject chamber for use with a hydrocyclone for separating a fiber suspension into a heavy fraction substantially containing heavy contaminants and a light fiber fraction substantially containing fibers, the hydrocyclone comprising a housing with a circumferential wall that defines an elongated separation chamber with two opposite ends and with a center axis extending between the opposite ends, an inlet member for supplying the fiber suspension substantially tangentially into the separation chamber at one end thereof, so that the fiber suspension flows in a vortex in the separation chamber, and a first outlet member for discharging an accept fraction from the separation chamber at the one end, the reject chamber being adapted to be connected at the other end thereof for discharging the heavy fraction from the separation chamber, the reject chamber having an internal cavity, a reject inlet portion having a reject inlet into the internal cavity, and a reject outlet portion having a wall and a reject outlet out of the internal cavity, a longitudinal axis of the reject outlet portion being angled relative to a longitudinal axis of the reject inlet portion, and at least two bumps in the reject outlet portion wall, each of which extend into the internal cavity from the reject outlet portion, the reject chamber taken along a cross section between the bumps having symmetrical sides.

3. The reject chamber according to claim 1 wherein the stem is between 5 mm to 20 mm in length, but extends no more than 7 mm above the bumps, an overall length of the reject chamber is between 60 mm and 100 mm, a diameter of the reject inlet 68 is between 30 mm and 100 mm, and wherein the bumps are between 1 mm and 10 mm high, and an opening into the reject outlet portion is between 30 mm and 80 mm in diameter.

4. A reject chamber for use with a hydrocyclone for separating a fiber suspension into a heavy fraction substantially containing heavy contaminants and a light fiber fraction substantially containing fibers, the hydrocyclone comprising a housing with a circumferential wall that defines an elongated separation chamber with two opposite ends and with a center axis extending between the opposite ends, an inlet member for supplying the fiber suspension substantially tangentially into the separation chamber at one end thereof, so that the fiber suspension flows in a vortex in the separation chamber, and a first outlet member for discharging an accept fraction from the separation chamber at the one end, the reject chamber being adapted to be connected at the other end thereof for discharging the heavy fraction from the separation chamber, the reject chamber having an internal cavity, a reject inlet portion having a reject inlet into the internal cavity, and a reject outlet portion having a wall and a reject outlet out of the internal cavity, a longitudinal axis of the reject outlet portion being angled relative to a longitudinal axis of the reject inlet portion, a stem that extends into the internal cavity from the reject outlet portion along the longitudinal axis of the reject inlet portion, and at least two bumps in the reject outlet portion wall, each of which extend into the internal cavity from the reject outlet portion and on opposite sides of the stem, the reject chamber taken along a cross section through the stem and between the bumps having symmetrical sides.

5. The reject chamber according to claim 4 wherein the stem is between 5 mm to 20 mm in length, but extends no more than 7 mm above the bumps, the overall length of the reject chamber is between 60 mm and 100 mm, the diameter of the reject inlet 68 is between 30 mm and 100 mm, the bumps are between 1 mm and 10 mm high, and an opening into reject outlet portion is between 30 mm and 80 mm in diameter.

* * * * *